US006761946B2

(12) United States Patent
Corapi

(10) Patent No.: US 6,761,946 B2
(45) Date of Patent: Jul. 13, 2004

(54) DECORATIVE WINDOW SYSTEM

(75) Inventor: Robert A. Corapi, Glenside, PA (US)

(73) Assignee: Victoria Glass, Ltd., Glenside, PA (US)

( * ) Notice: Subject to any disclaimer, the term of this patent is extended or adjusted under 35 U.S.C. 154(b) by 0 days.

(21) Appl. No.: 10/366,065

(22) Filed: Feb. 13, 2003

(65) Prior Publication Data

US 2003/0161982 A1 Aug. 28, 2003

Related U.S. Application Data

(60) Provisional application No. 60/359,426, filed on Feb. 25, 2002.

(51) Int. Cl.[7] ..... B44F 1/06
(52) U.S. Cl. ..... 428/38
(58) Field of Search ..... 428/38

(56) References Cited

U.S. PATENT DOCUMENTS

| | | | |
|---|---|---|---|
| 3,512,320 | A | 5/1970 | Ferron et al. |
| 4,154,880 | A | 5/1979 | Drennan |
| 4,252,847 | A | 2/1981 | DelGrande |
| 4,335,170 | A | 6/1982 | Butler |
| 4,343,758 | A | 8/1982 | Goralnik |
| 4,438,165 | A | 3/1984 | Butler |
| 4,610,901 | A | 9/1986 | Linscott |
| 4,619,850 | A | 10/1986 | Charlton |
| 4,756,938 | A | 7/1988 | Hickman |
| 5,045,370 | A | 9/1991 | Raum |
| 5,098,760 | A | 3/1992 | Fletcher |
| 5,418,021 | A | 5/1995 | Kim |
| 5,494,715 | A | 2/1996 | Glover |
| 5,834,124 | A | 11/1998 | Pease, III et al. |
| 5,853,835 | A | 12/1998 | Leniton |

*Primary Examiner*—Alexander S. Thomas
(74) *Attorney, Agent, or Firm*—Michael G. Crilly, Esq.

(57) ABSTRACT

The present invention is a decorative window system (1) that is mechanically robust, minimizes heat conduction, prevents water and wind infiltration, yet retains the physical characteristics of traditional divided glass construction. The preferred embodiment of the invention is a multi-glazed panel (12) comprised of a framework (11) of T-shaped came (2) dividing and supporting a plurality of glazing elements (3) thereafter bonded to a glazing panel (5) via a laminating layer (4). C-shaped came (14) is attached to or strip-shaped came (6) adhered via laminating tape (15) and a sealant (16) to the glazing panel (5) opposite of the laminating layer (4) so as to match the pattern formed by the framework (11). In an alternate embodiment, a first multi-glazed panel (21) is bonded to an oppositely disposed second multi-glazed panel (22) of likewise construction via a laminating layer (4).

10 Claims, 4 Drawing Sheets

DECORATIVE WINDOW SYSTEM

CROSS REFERENCE TO RELATED APPLICATIONS

This application claims benefit under 35 U.S.C. 119(e) from U.S. Provisional Application No. 60/359,426 filed on Feb. 25, 2002.

FEDERALLY SPONSORED RESEARCH OR DEVELOPMENT

None.

BACKGROUND OF THE INVENTION

1. Field of the Invention

The present invention generally relates to a decorative window system. Specifically, the invention is comprised of glazing elements disposed within a came framework thereafter adhered to a glazing panel or likewise constructed multi-glazed panel so as to provide a mechanically-robust, efficient barrier having the visual characteristics of divided glass construction.

2. Description of the Related Art

Traditional stained and leaded glass windows are typically constructed of panes secured within an H-shaped came framework. Such windows are aesthetically pleasing because of physical variations within and between glass panes which are further accentuated by the visual division provided by the came. However, traditional designs are mechanically weak, poor thermal barriers, and marginal environmental barriers. The related arts neither describe nor claim a divided pane window that is mechanically robust, an efficient thermal barrier, and an effective environmental barrier, yet retains the visual distinctiveness of traditional construction.

What is currently required is a window system composed of glazing materials within a metal came framework that is mechanically robust, minimizes heat conduction, prevents water and wind infiltration, yet retains the physical characteristics of traditional divided glass construction.

SUMMARY OF THE INVENTION

An object of the present invention is to provide a mechanically robust window system having the physical characteristics of traditional divided glass construction.

Another object of the present invention is to provide a window system with improved thermal barrier performance having the physical characteristics of traditional divided glass construction.

Another object of the present invention is to provide a window system with improved environmental barrier performance having the physical characteristics of traditional divided glass construction.

A preferred embodiment of the present invention is composed of a framework of T-shaped metal came dividing and supporting a plurality of glazing elements. Came elements are shaped and soldered to form a desired pattern. Glazing elements are adhered to the framework via laminating tape and a sealant. A laminating layer, typically composed of a polyvinyl butyral, an aliphatic polyurethane, or a cured resin, is provided opposite of the framework so as to bond glazing elements and framework to a glazing panel. Strip shaped came leaf is adhered via laminating tape and a sealant to the glazing panel opposite of the laminating layer so as to match the pattern formed by the framework. Glazing elements and panes may be composed of a variety of glass materials including but not limited to float, stained, and leaded. Laminating layer may provide a thermal barrier between glazing elements and glazing panel, thereby short circuiting thermal conduction through the window system.

An alternate embodiment of the decorative window system is comprised of a multi-glazed panel having a framework of T-shaped metal came supporting a plurality of glazing elements bonded via a laminating layer to an oppositely disposed panel of likewise construction.

Additional embodiments of the described arrangements further comprise a thermally insulated spacer, composed of material understood in the art, mechanically fixed to or adhered to a glazing panel or a second multi-glazed panel opposite of said laminating layer. A second glazing panel is thereafter attached to the spacer and separated from the glazing panel by air or a conduction resistive gas.

In yet other embodiments of the described arrangements, a frame composed of C-shaped metal came is provided and thereby mechanically attached about the edge of the window system. Alternately, strip shaped or T-shaped metal came may be adhered via laminating tape and a sealant to glazing elements and glazing panel about the perimeter of the window system.

Several advantages are offered by the present invention. The invention provides the strength of a continuous glass panel without compromising the aesthetics of divided glass construction. The invention provides both thermal and environmental barriers within a low profile design. The invention is resistant to age related degradation typically found in divided glass having H-shaped came construction.

BRIEF DESCRIPTION OF THE DRAWINGS

The invention will now be described in more detail, by way of example only, with reference to the accompanying drawings, in which.

REFERENCE NUMERALS

Figure 1:
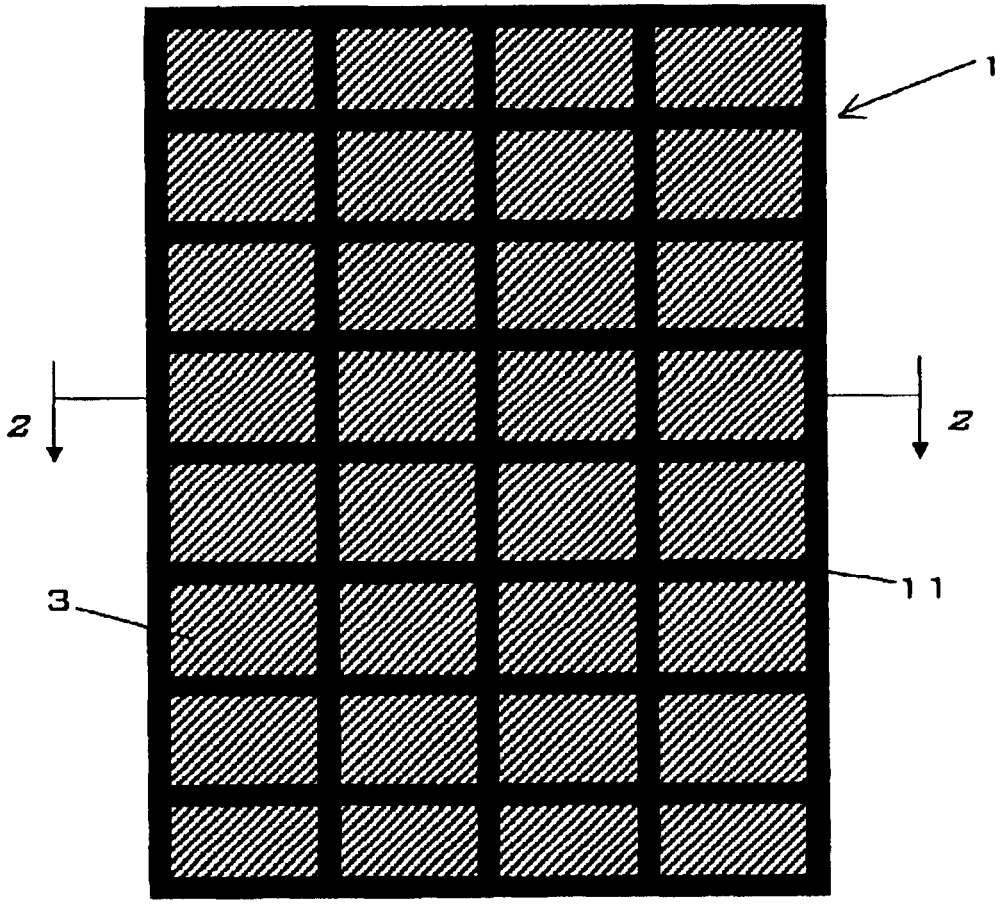
FIG. 1 is a plan view of the present invention showing a plurality of glazing elements disposed within a metal came framework.

1 Window system
2 T-shaped came
3 Glazing element
4 Laminating layer
5 Glazing panel
6 Strip shaped came leaf
7 Exterior
8 Interior
9 Spacer
10 Second glazing panel
11 Framework
12 Multi-glazed panel
13 Cavity
14 C-shaped came
15 Laminating tape
16 Weather seal
17 Transparent tape
18 Laminating tape
20 Double-sided tape
21 First multi-glazed panel
22 Second multi-glazed panel
23 Leaf
24 Heart

DESCRIPTION OF THE INVENTION

Figure 2:
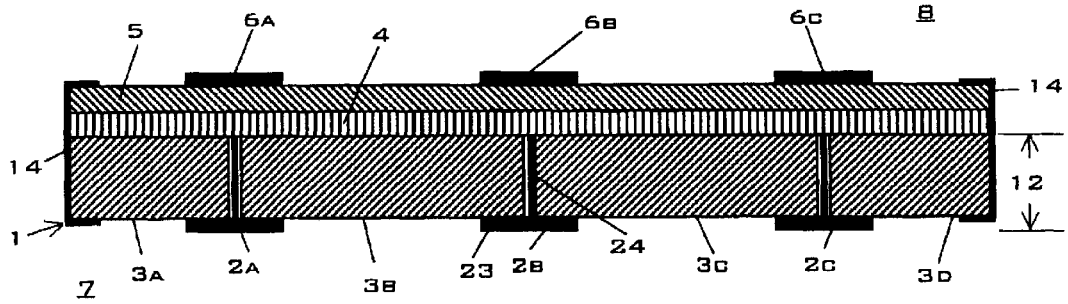
FIG. 2 is a section view of a preferred embodiment of the present invention showing glazing elements within a metal framework comprised of T-shaped came and thereafter bonded via a laminating layer to a glazing panel.
Figure 3:
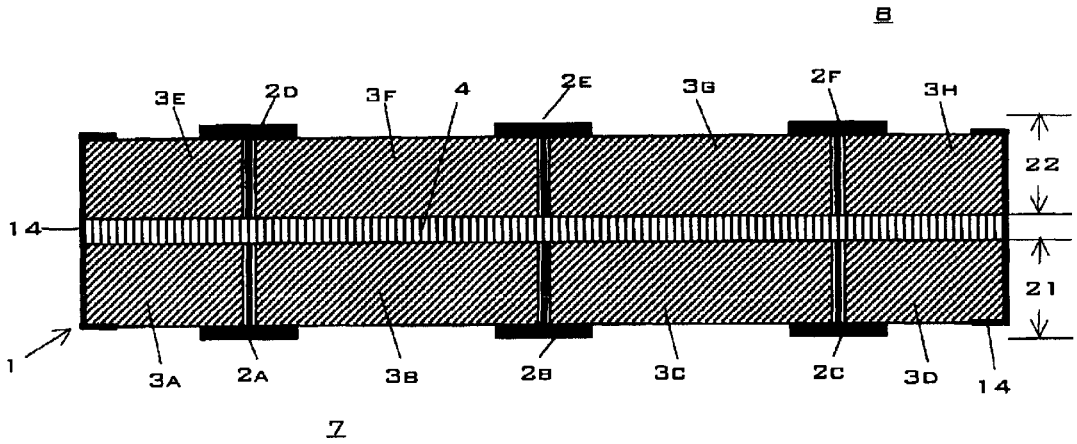
FIG. 3 is a section view of an alternate embodiment of the present invention showing glazing elements within a metal framework comprised of T-shaped came and thereafter bonded via a laminating layer to a second element of likewise construction.
Figure 4:
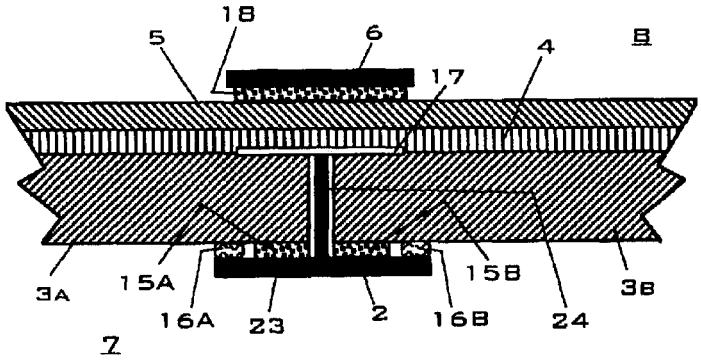
FIG. 4 is an enlarged section view showing T-shaped and strip shaped came leaf adhered to glazing elements via laminating tape and sealant.
Figure 5:
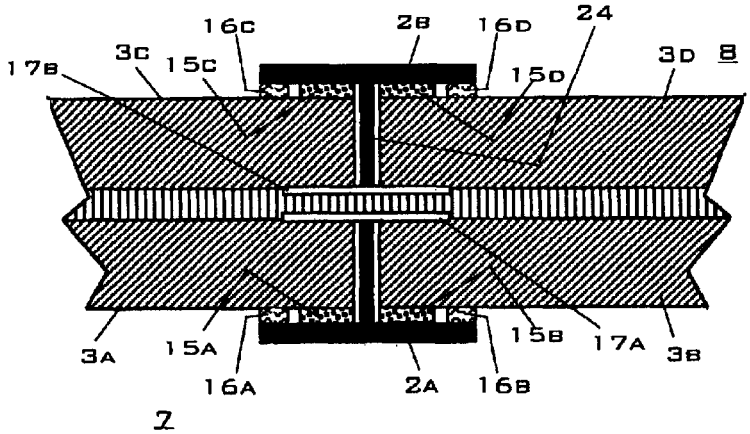
FIG. 5 is an enlarged section view showing two parallel disposed T-shaped came adhered to glazing units via laminating tape and sealant.
Figure 6:
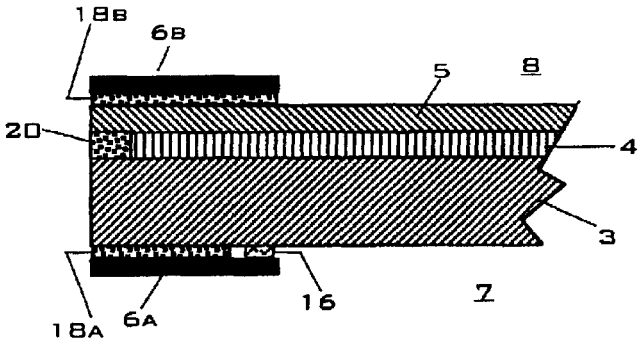
FIG. 6 is an enlarged section view showing two strip shaped came leaf parallel disposed and adhered to glazing units via laminating tape and sealant adjacent to edge of window system.
Figure 7:
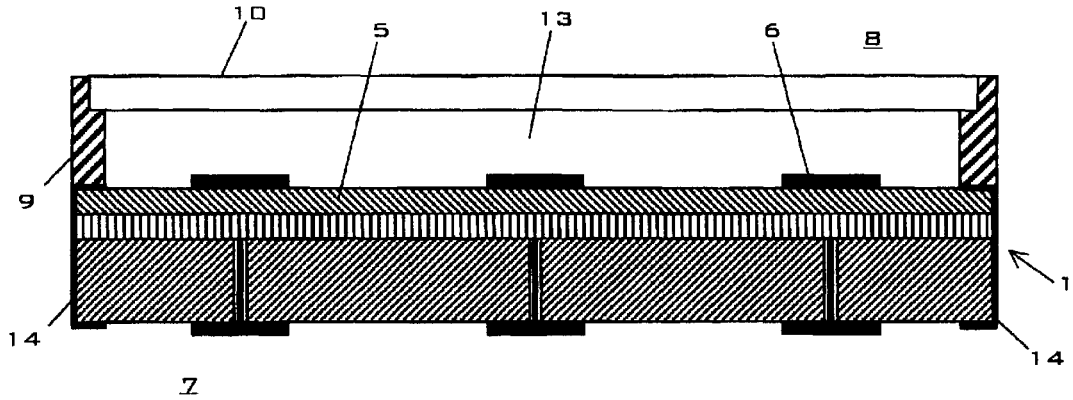
FIG. 7 is a section view of an alternate embodiment further comprising a second glazing panel attached to the present invention via a nonconductive spacer and having a cavity filled with a gas so as to provide a thermal barrier.
Figure 8:
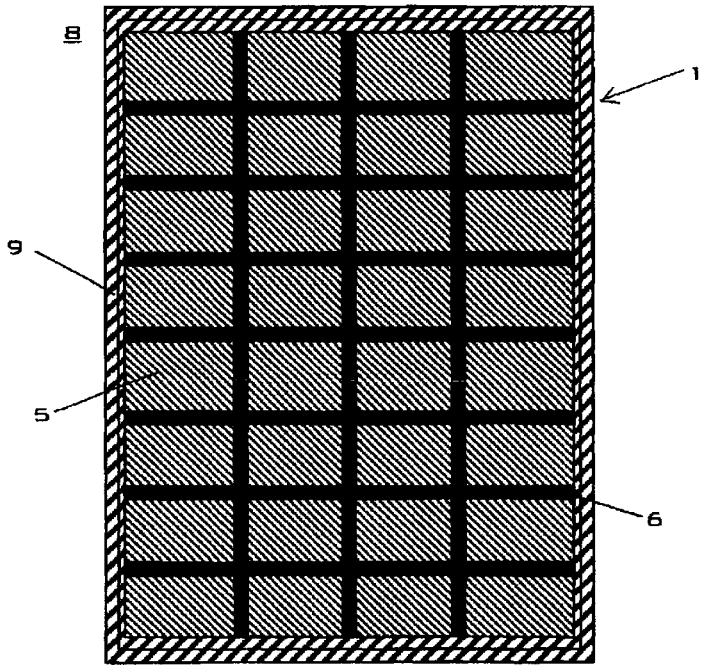
FIG. 8 is a plan view of the alternate embodiment in FIG. 7 showing spacer attached about the perimeter of the window system.

FIG. 1 describes an exemplary embodiment of the present invention. FIG. 2 describes a preferred embodiment of the present invention having T-shaped came 2 along one surface of the window system 1. FIG. 3 describes an alternate embodiment having T-shaped came 2 along both surfaces of the window system 1. FIGS. 4–6 describe the arrangement of T-shaped came 2, strip shaped came leaf 6, glazing elements 3, and a glazing panel 5 to form a window system 1. FIGS. 7 and 8 describe an alternate embodiment wherein a thermally resistive spacer 9 and a second glazing panel 10 provide a cavity 13 about one surface of the window system 1 further enhancing thermal performance. Drawings are not to scale.

Referring now to FIG. 1, a window system 1 is shown with framework 11 separating a plurality of glazing elements 3. While a rectangular-shaped framework 11 is shown, a variety of linear and non-linear patterns are equally applicable.

Referring now to FIG. 2, a preferred embodiment is shown comprised of a multi-glazed panel 12 bonded to a glazing panel 5. The multi-glazed panel 12 is comprised of a framework 11 and a plurality of glazing elements 3A–3D. Framework 11 is fabricated from metal came, preferably a weather resistant material examples including but not limited to lead, zinc, brass, or aluminum, having a T-shaped cross section perpendicularly disposed to its length.

T-shaped came 2 is fabricated via several methods. Such methods include extruding or roll forming softened came material through dies with the desired cross sectional shape or modifying H-shape came by removing one leaf 23 from the heart 24.

A framework 11 was constructed by shaping came and thereafter soldering two or more came so as to form the desired pattern. In preferred embodiments, the length of the heart 24 was no greater than the thickness of the glazing elements 3, as represented in FIGS. 4 and 5.

Glazing elements 3 are composed of a variety of glass types and formulations including but not limited to float, stained, and leaded. While various shapes and profiles are possible, preferred glazing elements 3 were planar and either rectangular or square shaped.

Glazing elements 3 are positioned within the framework 11 either freely movable or fixed. When fixed, glazing elements 3 are bonded to the framework 11 via methods understood in the art. For example, FIG. 4 shows T-shaped came 2 between and bonded to two planar disposed glazing elements 3A, 3B. Two strips of laminating tape 15A, 15B were applied in a parallel fashion to the planar disposed leaf 23 comprising the T-shaped came 2. Glazing elements 3A, 3B were thereafter placed within the framework 11 and pressed onto the laminating tape 15A, 15B so as to achieve the desired bond. While a variety of double-sided laminating tapes 15 are known within the art, preferred embodiments of the present invention were fabricated using a structural bonding tape, preferably a closed-cell acrylic carrier for joining transparent material, one example being VHB tape manufactured by the 3M Corporation. A weather seal 16, preferably a water resistant silicon caulk, was thereafter applied between leaf 23 and glazing elements 3A, 3B to prevent moisture accumulating under the leaf 23 and contaminating the laminating layer 4.

Again referring to FIG. 2, a multi-glazed panel 12 was bonded to a glazing panel 5 via a laminating layer 4. Exemplary materials comprising the laminating layer 4 include plasticized polyvinyl butyrals (PVB), aliphatic polyurethanes, and cured resins.

The present invention was laminated via techniques understood in the art, as described in the *Laminated Glass Design Guide,* 2000 *Edition*, published by the Laminating Division of the Glass Association of North America. For example, a laminating layer 4 was produced by placing a sheet of either plasticized PVB or aliphatic polyurethane between a pair of oppositely disposed and parallel glazing elements 3A–3D and 3E–3H, as in FIG. 3, or an arrangement of parallel disposed glazing elements 3A–3D and glazing panel 5, as in FIG. 2. The glass sandwich was exposed to heat and pressure which bonded the sheet material to the neighboring glass.

In preferred embodiments, the laminating layer 4 was fabricated using cast-in-place resins. A liquid-based curable resin was poured or pumped into the space between multi-glazed panel 12 and glazing panel 5. A double-side tape 20, one example being VHB was applied via techniques understood in the art, about a perimeter within the window system 1 thereby bonding the multi-glazed panel 12 to the glazing panel 5 so as to form a dam to confine the liquid resin between glazing elements 3 and glazing panel 5, see FIG. 6. The double-sided tape 20 included an inlet hole for the injection of resin and an outlet hole to allow the displacement of air as resin filled the space between panels. The resin was exposed to either ultraviolet light or heat thereby curing the resin and bonding the multi-glazed panel 12 to the glazing panel 5 via a laminating layer 4 having a thickness equal to that of the double sided tape 20. Self curing resins were equally applicable to the present invention. A tape thickness of 1.5 millimeters was sufficient to allow injection of a liquid-based curable resin and to achieve a sufficiently strong bond with the neighboring glass elements. In some embodiments, a transparent tape 17 was adhered over joints between glazing elements 3 so as to prevent contact between laminating layer 4 and T-shaped came 2, as shown in FIGS. 4 and 5.

The thermal efficiency of the window system 1 is application dependent and proportional to the thickness of the laminating layer 4, as well as the thermal conductivity characteristics of the laminating material. For example, a larger temperature differential between exterior 7 and interior 8 requires a thicker laminating layer 4 to prevent undesired heat flow between glazing panel 5 and glazing elements 3. Whereas a smaller temperature differential requires a thinner laminating layer 4. In preferred embodiments, the laminating layer 4 was composed of a material with a low coefficient of thermal conductivity, thereby providing a thermal short circuit between multi-glazed panel 12 and glazing panel 5.

Again referring to FIG. 2, a strip shaped came leaf 6 was adhesively bonded to the glazing panel 5 opposite of the laminating layer 4 and matching the pattern of the framework 11. Strip shaped came leaf 6 is comprised of a planar disposed metal, examples including but not limited to lead, zinc, brass, and aluminum, having the visual appearance of the T-shaped came 2. Bonding was achieved via laminating tape 18 as shown in FIGS. 4 and 6, whereas a weather seal 16 was optional.

Referring now to FIG. 3, an alternate embodiment is shown comprising a first multi-glazed panel 21 bonded to a second multi-glazed panel 22. First multi-glazed panel 21 and second multi-glazed panel 22 were fabricated separately and bonded via a laminating layer 4, as described above. In this embodiment, views from both exterior 7 and interior 8 represented a traditional multi-pane unit separated by H-shaped came.

In yet other embodiments, it was desired to provide came about the perimeter of the window system 1. In preferred embodiments, several C-shaped came 14 members were soldered to one another about the perimeter of the window system 1 to form a frame-like construction thereby fixing the came to the unit, as indicated in FIGS. 2 and 3. Alternately, strip shaped came leaf 6 was adhesively bonded about the perimeter of a multi-glazed panel 12 and a glazing panel 5, as shown in FIG. 6, and likewise applicable to first multi-glazed panel 21 and second multi-glazed panel 22 in FIG. 3. In yet other embodiments, the window system 1 was terminated by a perimeter composed of T-shaped came 2.

Referring now to FIG. 6, strip shaped came leaf 6A, 6B was bonded to the surface of the element via laminating tape 18A, 18B. A weather seal 16 was applied between strip shaped came leaf 6 and glazing elements 3.

Additional thermal efficiency was achieved via the addition of a spaced panel arrangement filled with air or a nonconductive gas. Referring now to FIG. 7, the window system 1 in FIG. 2 is shown having a spacer 9 attached to the C-shaped came 14 via laminating tape 15 or other mechanical means understood in the art. However, it is possible to directly attach the spacer 9 to a glazing panel 5 or a second multi-glazed panel 22.

The spacer 9 was constructed of a material having a low coefficient of thermal conductivity, thereby providing a thermal short circuit. A second glazing panel 10 was thereafter mechanically fixed or bonded to the spacer 9, via techniques understood in the art, and parallel to the glazing panel 5 thereby forming a cavity 13. The cavity 13 was filled via techniques understood in the art with air or an inert gas, preferably argon, to prevent condensation and to impede thermal conduction. Seams between spacer 9 and both second glazing panel 10 and glazing panel 5 were sealed using techniques understood in the art to prevent leakage of the gas from the cavity 13. FIG. 8 shows a representative view of the described embodiment from the interior 8 perspective. The described spacer 9 and second glazing panel 10 are equally applicable to the window system 1 in FIG. 3.

The description above indicates that a great degree of flexibility is offered in terms of the present invention. Although the present invention has been described in considerable detail with reference to certain preferred versions thereof, other versions are possible. Therefore, the spirit and scope of the appended claims should not be limited to the description of the preferred versions contained herein.

What is claimed is:

1. A decorative window system comprising:

(a) a multi-glazed panel comprising a framework of T-shaped metal came and a plurality of glazing elements disposed within said framework; and (b) a glazing panel having a plurality of strip shaped came leaf adhered to one surface, said multi-glazed panel bonded to said glazing panel via a laminating layer so that said framework and said strip shaped came leaf are outwardly disposed, said laminating layer being a solid of planar extent completely between said multi-glazed panel and said glazing panel.

2. The decorative window system in claim 1, further comprising:

(c) a spacer fixed to said glazing panel opposite of said laminating layer; and (d) a second glazing panel fixed to said spacer and separated from said glazing panel by a gas, said glazing panel, said second glazing panel, and said spacer containing said gas.

3. The decorative window system of claim 1, further comprising:

(c) a came frame disposed about a perimeter of said decorative window system, said came frame contacting said multi-glazed panel, said glazing panel and said laminating layer.

4. The decorative window system in claim 3, further comprising:

(d) a spacer fixed to said glazing panel opposite of said laminating layer; and (e) a second glazing panel fixed to said spacer and apart from said glazing panel by a gas, said glazing panel, said second glazing panel, and said spacer containing said gas.

5. The decorative window system as in one of claims 1–4, wherein said laminating layer provides a thermal short circuit.

6. A decorative window system comprising:

(a) a first multi-glazed panel comprising a first framework of T-shaped metal came and a plurality of glazing elements disposed within said first framework; and (b) a second multi-glazed panel comprising a second framework of T-shaped metal came and a plurality of glazing elements disposed within said second framework, said first multi-glazed panel bonded to said second multi-glazed panel via a laminating layer so that said first framework and said second framework are outwardly disposed.

7. The decorative window system in claim 6, further comprising:

(c) a spacer fixed to said second multi-glazed panel opposite of said laminating layer; and (d) a glazing panel attached to said spacer and apart from said second multi-glazed panel by a gas, said glazing panel, said second multi-glazed panel, and said spacer containing said gas.

8. The decorative window system of claim 6, further comprising:

(c) a came frame disposed about a perimeter of said decorative window system.

9. The decorative window system in claim 8, further comprising:

(d) a spacer fixed to said second multi-glazed panel opposite of said laminating layer; and (e) a glazing panel attached to said spacer and apart from said second multi-glazed panel by a gas, said glazing panel, said second multi-glazed panel, and said spacer containing said gas.

10. The decorative window system as in one of claims 6–9, wherein said laminating layer provides a thermal short circuit.

* * * * *